US009689124B2

(12) United States Patent
Harman et al.

(10) Patent No.: US 9,689,124 B2
(45) Date of Patent: Jun. 27, 2017

(54) REINFORCED GUARDRAIL EXTRUDER HEAD

(71) Applicants: Joshua Harman, Swords Creek, VA (US); Donald Leo Monin, Jr., Alexandria, VA (US)

(72) Inventors: Joshua Harman, Swords Creek, VA (US); Donald Leo Monin, Jr., Alexandria, VA (US)

(73) Assignee: SPIG Industry, LLC, Bristol, VA (US)

( * ) Notice: Subject to any disclaimer, the term of this patent is extended or adjusted under 35 U.S.C. 154(b) by 559 days.

(21) Appl. No.: 14/177,366

(22) Filed: Feb. 11, 2014

(65) Prior Publication Data

US 2014/0231735 A1 Aug. 21, 2014

Related U.S. Application Data

(60) Provisional application No. 61/763,924, filed on Feb. 12, 2013.

(51) Int. Cl.
*E01F 15/14* (2006.01)

(52) U.S. Cl.
CPC ..... *E01F 15/143* (2013.01)

(58) Field of Classification Search
CPC ..... E01F 15/14; E01F 15/143; E01F 15/145; E01F 15/00
See application file for complete search history.

(56) References Cited

U.S. PATENT DOCUMENTS

| | | | | |
|---|---|---|---|---|
| 4,928,928 | A | 5/1990 | Buth et al. | |
| 6,715,735 | B2 | 4/2004 | Bligh et al. | |
| 7,185,882 | B2 * | 3/2007 | Buth | E01F 15/143 248/66 |
| 8,517,349 | B1 * | 8/2013 | Ross | E01F 15/143 256/1 |

* cited by examiner

*Primary Examiner* — Michael P Ferguson

(57) ABSTRACT

A guardrail extruder head includes: top and bottom feeder channels; an impact plate; a top plate connecting the impact plate to the top feeder channel; a bottom plate connecting the impact plate to the bottom feeder channel; a front extruder plate coupled between the top and bottom plates; a curved deflector plate attached to the front extruder plate and coupled between the top and bottom plates; a front brace on the front extruder plate near the curved deflector plate and coupled between the top and bottom plates; a back extruder plate opposite to the front extruder plate and coupled between the top and bottom plates; a front side plate and a back side plate positioned between the top and bottom feeder channels; a back brace on the back extruder plate near the feeder channels and coupled between the top and bottom plates; and an impact force transfer brace coupled to the front brace and the impact plate.

13 Claims, 10 Drawing Sheets

REINFORCED GUARDRAIL EXTRUDER HEAD

This invention claims the benefit of U.S. Provisional Patent Application No. 61/763,924 filed on Feb. 12, 2013, which is hereby incorporated by reference in its entirety.

BACKGROUND OF THE INVENTION

Field of the Invention

The embodiments of the invention relate to a guardrail extruder head, and more particularly, to reinforced guardrail extruder head.

Discussion of the Related Art

In general, a guardrail extruder head is located at the oncoming traffic ends of guardrail runs. The guardrail extruder head is designed to deflect a side impact by a vehicle and, in the alternative, absorb a head-on or shallow angle impact by a vehicle. A guardrail extruder head absorbs energy from a head-on impact to its impacting head by receiving a W-beam guardrail though a feeder chute, flattening the guardrail beam in an extruder throat by squeezing the W-shape out of the guardrail beam, and then deflecting the flattened guardrail beam through a curved deflecting plate. Thus, W-beam guardrail should feed into the guardrail extruder head reliably and slow an impacting vehicle as the vehicle runs down a length of W-beam guardrail while flattening the guardrail beam and deflecting the flattened guardrail. Prior art examples of such guardrail extruder heads and further description of their operation can be found in U.S. Pat. Nos. 6,715,735 and 4,928,928.

FIG. 1*a* shows a top view of a prior art guardrail extruder head. FIG. 1*b* shows a front view of a prior art guardrail extruder head. The prior art guardrail extruder head 1 generally has a feeder chute section A, an extruder throat section B, a deflector section C and an impact head section D.

As shown in FIGS. 1*a* and 1*b*, the oncoming traffic end 2 of a W-beam guardrail 2 is pre-positioned in the feeder chute section A. Further, the guardrail end 2' of the guardrail 2 slightly protrudes a distance E into the extruder throat section E. As a result of either a head-on or shallow angle vehicle impact on the impact head section D, the guardrail extruder head 1 moves along the guardrail 2 and the guardrail end 2' feeds into the extruder throat section B such that the guardrail is flattened, and then the guardrail end 2' moves into the deflector section C such that flattened guardrail is deflected out of the guardrail extruder head 1. Sometimes, the guardrail end 2' may not protrude a distance E into the extruder throat section E due to improper mounting of the guardrail extruder head 1, unfavorable installation conditions or snow removal equipment repositioning the guardrail extruder head 1 on the guardrail 2. Such a lack of protrusion into the extruder throat may prevent the guardrail 2 from entering the extruder throat section B during an impact.

FIGS. 1*a* and 1*b* show the feeder chute section A including a top feeder channel 3*a* and a bottom feeder channel 3*b* between which the W-beam guardrail 2 is pre-positioned. A front vertical feeder chute brace 4*a* and a back vertical feeder chute brace 4*b* are coupled to the top feeder channel 3*a* and the bottom feeder channel 3*b* at one end of the feeder chute section A. A top hanging bracket 5*a* is attached to the top feeder channel 3*a* and a bottom hanging bracket 5*b* is attached to the bottom feeder channel 3*b* near the other end of the feeder chute section A. As shown in FIG. 1*a*, the top feeder channel 3*a* and the bottom feeder channel 3*b* in the feeder chute section A is about 36 inches long. The feeder chute section A guides the guardrail extruder head 1 along the path of the W-beam guardrail 2 during an impact.

The top feeder channel 3*a* and the bottom feeder channel 3*b* are attached to the extruder throat section B, as shown in FIGS. 1*a* and 1*b*. The extruder throat section B includes a first portion of the front plate 6*a*, which is a front extruder plate 6*a*', and a back extruder plate 6*b*. The separation distance F, as shown in FIG. 1*a*, between the front extruder plate 6*a*' and the back extruder plate 6*b* decreases as the front extruder plate 6*a*' and the back extruder plate 6*b* extend from the feeder chute section A to the deflector section C. The separation distance F is maintained by the attachments of the portion of the front extruder plate 6*a*' and the back extruder plate 6*b* to both the top plate 7*a* and the bottom plate 7*b*. A front vertical extruder brace 8 is attached to the first portion of the front extruder plate 6*a*' and coupled between the top plate 7*a* and the bottom plate 7*b*. A back vertical extruder brace 9 is attached to the back extruder plate 6*b* and coupled between the top plate 7*a* and the bottom plate 7*b*. Further, the back vertical extruder brace 9 is at the end of the back extruder plate 6*b*. A post breaker 10 is attached to the back extruder plate 6*b* and the back vertical extruder brace 9.

As shown in FIGS. 1*a* and 1*b*, the deflector section C extends from the end of the back extruder plate 6*b* in the extruder throat section B to the impact plate 11 of the impact head section D. The deflector section C includes a curved second portion of the front plate 6*a* that is otherwise known as the deflector plate 6*a*". The curve in the deflector plate 6*a*" deflects the guardrail 2, which was previously flattened in the extruder throat section B second portion, as the guardrail extruder head 1 moves along the path of a guardrail 2 during an impact. The deflector plate 6*a*" is attached between the top plate 7*a* and the bottom plate 7*b*.

The impact head section D, as shown in FIGS. 1*a* and 1*b*, includes an impact plate 11 with two outwardly projecting sides. The impact plate 11 is attached to the top plate 7*a* and the bottom plate 7*b*. Further, the impact plate 11 is attached to an impact force transfer brace 12.

To assist in directing impact energy on the impact plate 11 down the guardrail 2 so as to move the head along the path of the guardrail 2 during an impact, the impact force transfer brace 12 is attached to the front extruder plate 6*a* in the extruder section B and coupled between the impact plate 11 and the front vertical extruder brace 8. More specifically, the impact force transfer brace 12 is coupled to the back of the impact plate 11. The coupling of the impact force transfer brace 12 to the impact plate 11 also increases the rigidity of the impact plate 11. Typically, the impact force transfer brace 12 of the prior art guardrail extruder head 1 is made of 0.25 inch thick steel plate. Further, the impact force transfer brace 12 in the prior art guardrail extruder head 1 is not located along the central longitudinal axis X-X' of the feeder chute section A but rather the entire transfer brace 12 of the prior art guardrail extruder head 1 is offset from the central longitudinal axis X-X'.

SUMMARY OF THE INVENTION

Accordingly, embodiments of the invention are directed to a reinforced guardrail extruder head that substantially obviates one or more of the problems due to limitations and disadvantages of the related art.

An object of embodiments of the invention is to provide a reinforced guardrail extruder head that will assuredly feed the prepositioned guardrail within the feeder chute into the extruder throat during an initial impact.

Another object of embodiments of the invention is to provide a reinforced guardrail extruder head with a feeder chute having an increased capability for guiding the guardrail extruder head along the path of guardrail during an impact.

Another object of embodiments of the invention is to provide a reinforced guardrail extruder head with improved stabilization of the feeder channels.

Another object of embodiments of the invention is to provide a reinforced guardrail extruder head with enhanced attachment of the feeder chute section to the extruder throat section.

Another object of embodiments of the invention is to provide a reinforced guardrail extruder head with improved central support of the impact plate.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the guardrail extruder head includes: a feeder chute having a top feeder channel and a bottom feeder channel with a central longitudinal axis; an impact plate for facing oncoming traffic; a top plate connecting the impact plate and the top feeder channel; a bottom plate connecting the impact plate and the bottom feeder channel; a front extruder plate extending from the feeder chute and coupled between the top plate and the bottom plate; a curved deflector plate attached to the front extruder plate and coupled between the top plate and the bottom plate; a front brace on the front extruder plate near the curved deflector plate and coupled between the top plate and the bottom plate; a back extruder plate opposite to the front extruder plate and coupled between the top plate and the bottom plate, the back extruder plate having a first end adjacent to the feeder chute and a second end opposite to the first end; a front side plate positioned between the top feeder channel and the bottom feeder channel; a back side plate positioned between the top feeder channel and the bottom feeder channel; a back brace on the back extruder plate near the second end and coupled between the top plate and the bottom plate; and an impact force transfer brace coupled to the front brace and the impact plate.

In another aspect, the guardrail extruder head includes: a feeder chute having a top feeder channel and a bottom feeder channel with a central longitudinal axis; an impact plate for facing oncoming traffic; a top plate connecting the impact plate and the top feeder channel; a bottom plate connecting the impact plate and the bottom feeder channel; a front extruder plate extending from the feeder chute and coupled between the top plate and the bottom plate; a curved deflector plate attached to the front extruder plate and coupled between the top plate and the bottom plate; a front brace on the front extruder plate near the curved deflector plate and coupled between the top plate and the bottom plate; a back extruder plate opposite to the front extruder plate and coupled between the top plate and the bottom plate, the back extruder plate having a first end adjacent to the feeder chute and a second end opposite to the first end; a front side plate extending from the front extruder plate between the top feeder channel and the bottom feeder channel; a back side plate extending from the back extruder plate between the top feeder channel and the bottom feeder channel; a back brace on the back extruder plate near the second end and coupled between the top plate and the bottom plate; and an impact force transfer brace coupled to the front brace and the impact plate.

In another aspect, a guardrail extruder head includes: a feeder chute having a top feeder channel and a bottom feeder channel with a central longitudinal axis; an impact plate for facing oncoming traffic; a top plate extending to the impact plate from the top feeder channel; a bottom plate extending to the impact plate from the bottom feeder channel; a front extruder plate extending from the feeder chute and coupled between the top plate and the bottom plate; a curved deflector plate attached to the front extruder plate and coupled between the top plate and the bottom plate; a front brace on the front extruder plate near the curved deflector plate and coupled between the top plate and the bottom plate; a back extruder plate opposite to the front extruder plate and coupled between the top plate and the bottom plate, the back extruder plate having a first end adjacent to the feeder chute and a second end opposite to the first end; a back side plate positioned between the top feeder channel and the bottom feeder channel adjacent to the first end; a front side plate positioned between the top feeder channel and the bottom feeder channel opposite the back side plate; a back brace on the back extruder plate near the second end and coupled between the top plate and the bottom plate; and an impact force transfer brace coupled between the front brace and the impact plate.

In yet another aspect, a guardrail extruder head includes: a feeder chute having a top feeder channel and a bottom feeder channel with a central longitudinal axis; an impact plate for facing oncoming traffic; a top plate connecting the impact plate and the top feeder channel; a bottom plate connecting the impact plate and the bottom feeder channel; a front extruder plate extending from the feeder chute and coupled between the top plate and the bottom plate; a curved deflector plate attached to the front extruder plate and coupled between the top plate and the bottom plate; a front brace on the front extruder plate near the curved deflector plate and coupled between the top plate and the bottom plate; a back extruder plate opposite to the front extruder plate and coupled between the top plate and the bottom plate, the back extruder plate having a first end adjacent to the feeder chute and a second end opposite to the first end; a back brace on the back extruder plate near the second end and coupled between the top plate and the bottom plate; and an impact force transfer brace between the front brace and the impact plate configured to have a first portion aligned with the central longitudinal axis, wherein a length of the feeder chute along the central longitudinal axis is at least three times greater than the distance along the central longitudinal axis from the first end to the curved deflector plate.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1A:
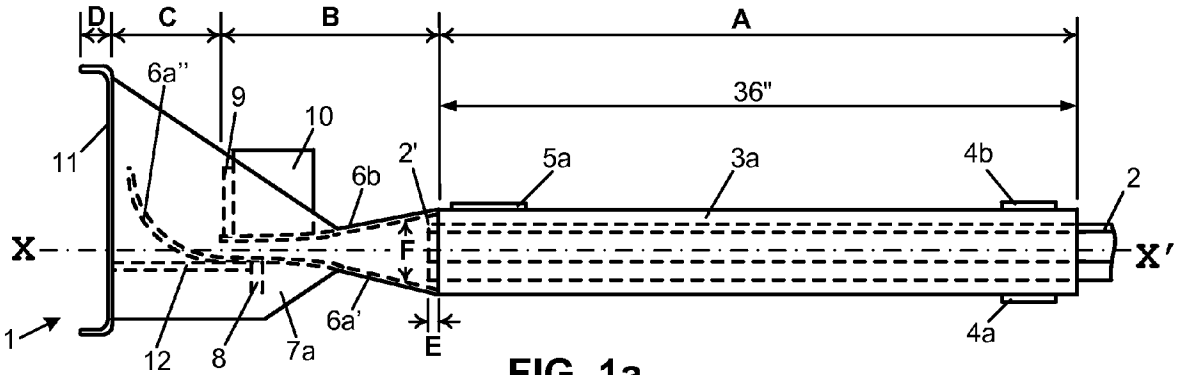
FIG. 1a PRIOR ART
FIG. 1*a* shows a top view of a prior art guardrail extruder head.
Figure 1B:
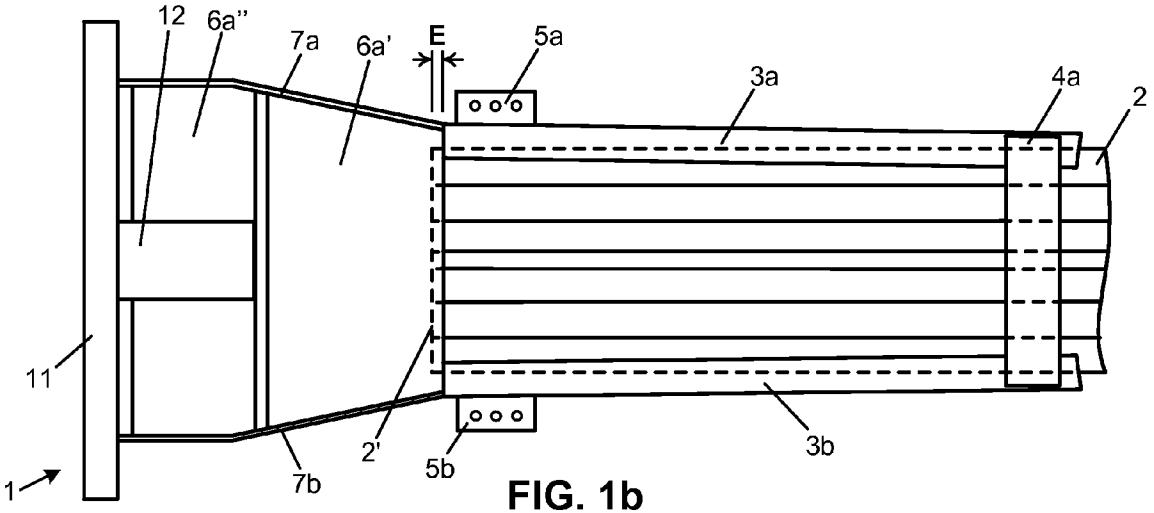
FIG. 1b PRIOR ART
FIG. 1*b* shows a front view of a prior art guardrail extruder head.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

In general, embodiments of the invention are directed toward an improved guardrail extruder head. Such an improved guardrail extruder head is intended for use with guardrail end terminal systems like those described in U.S. Pat. Nos. 6,715,735 and 4,928,928 that flatten the guardrail and then deflect the flattened guardrail to the side. The placement and operation of a guardrail extruder head in such guardrail end terminal systems is described in those patents and they are incorporated herein by reference.

Figure 2A:
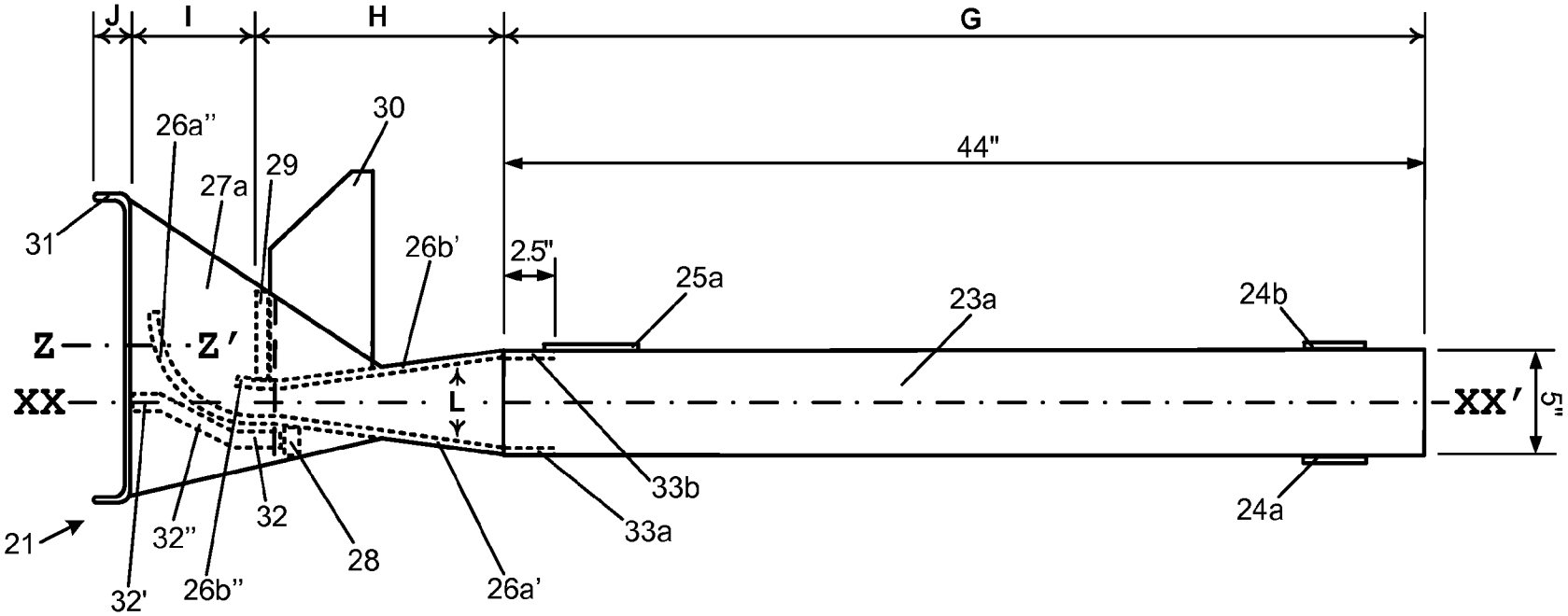
FIG. 2*a* shows a top view of a guardrail extruder head according to a first embodiment of the invention.
Figure 2B:
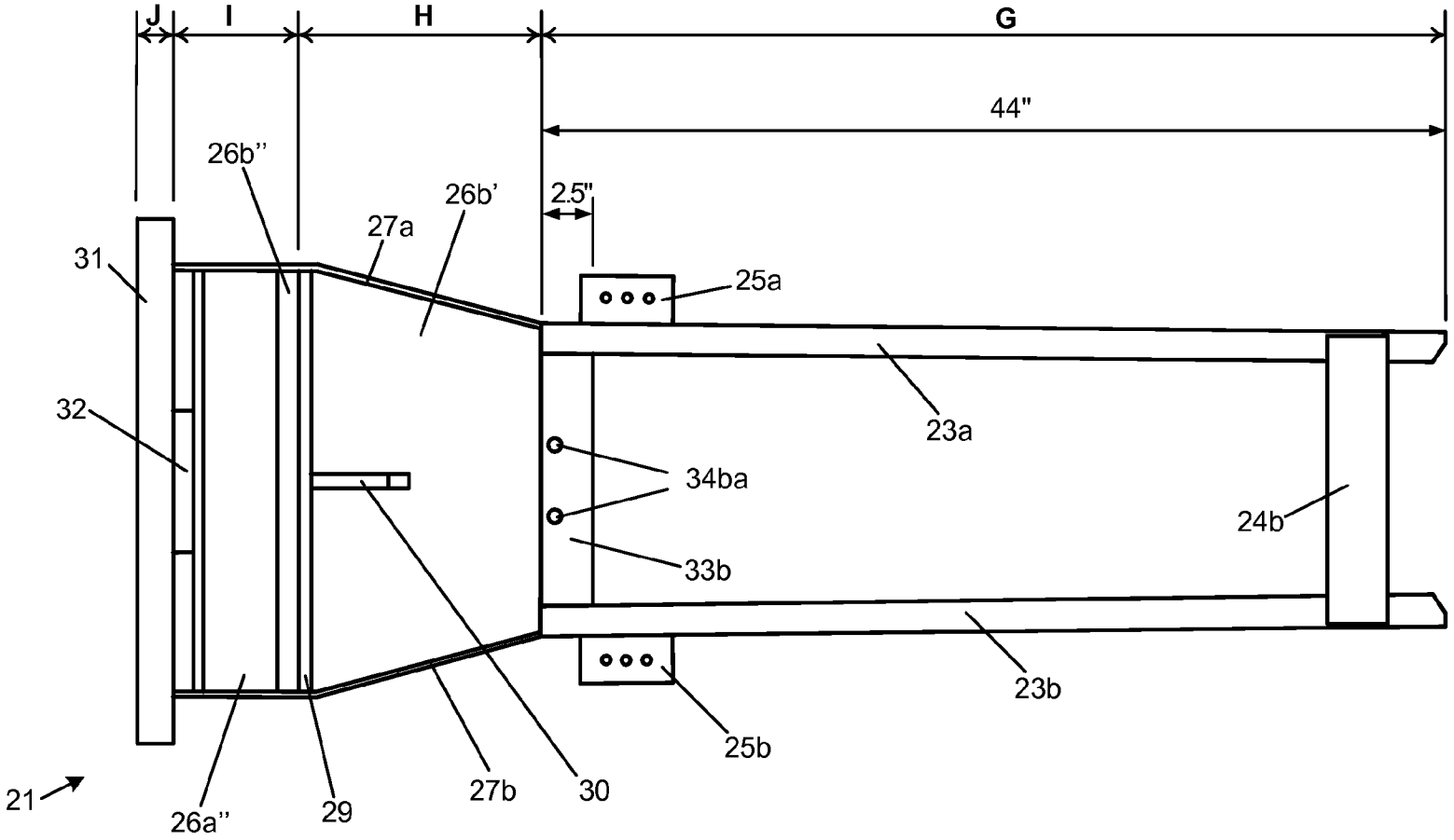
FIG. 2*b* shows a back side view of a guardrail extruder head according to the first embodiment of the invention.
Figure 2C:
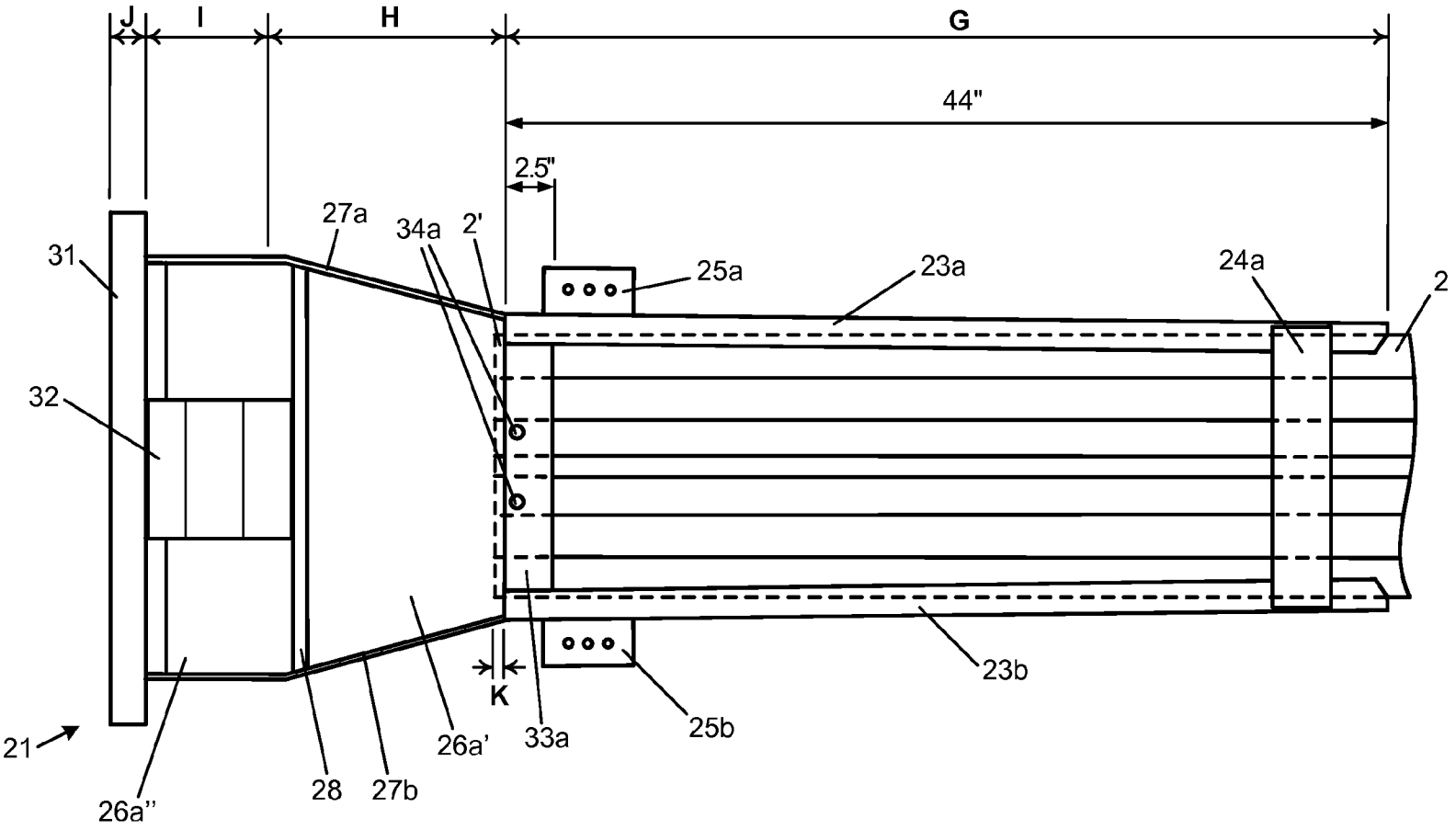
FIG. 2*c* shows a front side view of a guardrail extruder head according to the first embodiment of the invention.

FIG. 2*a* shows a top view of a guardrail extruder head according to a first embodiment of the invention. FIG. 2*b* shows a back side view of a guardrail extruder head according to the first embodiment of the invention. FIG. 2*c* shows a front side view of a guardrail extruder head according to the first embodiment of the invention.

As shown in FIGS. 2*a*, 2*b* and 2*c*, a guardrail extruder head 21 according to a first embodiment of the invention includes a feeder chute section G, extruder throat section H, a deflector section I and an impact head section J. As shown in FIG. 2*c*, the feeder chute section G receives a prepositioned W-beam guardrail 2 and guides the guardrail extruder head 21 down along the path of the W-beam guardrail 2 during an impact. As a result of either a head-on or shallow angle vehicle impact on the impact head section J, the guardrail extruder head 21 moves along the guardrail 2 and the guardrail end 2' feeds into the extruder throat section H such that the guardrail 2 is flattened, and then the guardrail end 2' moves into the deflector section I such that flattened guardrail 2 is deflected out of the guardrail extruder head 21.

FIGS. 2*a*, 2*b* and 2*c* show the feeder chute section G including a top feeder channel 23*a* and a bottom feeder channel 23*b*. A front vertical feeder chute brace 24*a* and a back vertical feeder chute brace 24*b* are coupled to the top feeder channel 23*a* and the bottom feeder channel 23*b* at one end of the feeder chute section G. A top hanging bracket 25*a* is attached to the top feeder channel 23*a* and a bottom hanging bracket 5*b* is attached to the bottom feeder channel 23*b* near the other end of the feeder chute section G. A front side panel 34*a* and a back side panel 34*b* are coupled between the top feeder channel 23*a* and the bottom feeder channel 23*b* at the end of the feeder chute section G. The front and back side panels 33*a* and 33 can be welded flush directly between the top feeder channel 23*a* and the bottom feeder channel 23*b*. By combining the front and back side panels 33*a* and 33*b* together with the front and back vertical feeder chute braces 24*a* and 24, the feeder channel 23*a* and the bottom feeder channel 23*b* are further stabilized with respect to each other. The front and back side panels 33*a* and 33 can have a width of about 2 to 4 inches, such as 2.5 inches.

As shown in FIG. 2*c*, the guardrail end 2' of the prepositioned W-beam guardrail 2 should protrude a distance K of about one inch into the extruder throat section H. However, there are instances due to improper mounting of the guardrail extruder head 21, unfavorable installation conditions or snow removal equipment repositioning the guardrail extruder head 1 on the W-beam guardrail 2. The lack of such a protrusion into the extruder throat is not an issue in embodiments of the invention since the front and back side panels 33*a* and 33*b* can still guide the guardrail end 2' of the prepositioned W-beam guardrail 2 into the extruder throat section H during an impact. The front and back side panels 33*a* and 33*b* can each include front and back witness holes 34*a* and 34*b* that should be blocked by the prepositioned W-beam guardrail 2. The front witness holes 34*a* should be directly opposite and opposing to the back witness holes 34*b*. The front and back witness holes 34*a* and 34*b* can have a diameter of about 0.75 inches to allow an inspection to determine if the guardrail end 2' of the prepositioned W-beam guardrail 2 is blocking opposing front and back witness holes 34*a* and 34*b*. Although pairs of witness holes are shown in each of the front and back side panels in FIG. 2*c*, single witness holes in the center part of each of the front and back side panels that correspond to each other are sufficient for determining a correctly prepositioned W-beam guardrail.

The top feeder channel 23*a* and the bottom feeder channel 23*b* are attached to the extruder throat section H, as shown in FIGS. 2*a*, 2*b* and 2*c*. The extruder throat section H includes a first portion of the front plate 26*a*, which is a front extruder plate 26*a*', and a first portion of the back plate 26*b*, which is a back extruder plate 26*b*'. The separation distance L, as shown in FIG. 2*a*, between the front extruder plate 26*a*' and the back extruder plate 26*b*' decreases as the front extruder plate 26*a*' and the back extruder plate 26*b*' extend from the feeder chute section G to the deflector section I. The separation distance L is maintained by welding the front extruder plate 26*a*' and the back extruder plate 26*b*' between both the top plate 27*a* and the bottom plate 27*b*. A front vertical extruder brace 28 is attached to the front extruder plate 26*a*' and coupled between the top plate 27*a* and the bottom plate 27*b*. A back vertical extruder brace 29 is at the end of the end of the back extruder plate 26*b*' and coupled between the top plate 27*a* and the bottom plate 27*b*. A post breaker 30 is attached to the back extruder plate 26*b* and the back vertical extruder brace 29. Although the front and back side panels 33*a* and 33*b* of the feeder chute section G are shown in FIGS. 2*a*, 2*b* and 2*c* to be respectively abutting the front and back extruder plates 26*a*' and 26*b*', the front and back side panels 33*a* and 33*b* of the feeder chute section G can be respectively welded to the front and back extruder plates 26*a*' and 26*b*' of the extruder throat section.

As shown in FIGS. 2*a*, 2*b* and 2*c*, the deflector section I extends from the end of the back extruder plate 26*b*' in the extruder throat section H to the impact plate 21 of the impact head section J. The deflector section I includes the second portion of the back plate 26*b*, which is the welding lip 26*b*", extending from the back vertical extruder brace 29 of the extruder throat section H and into the deflector section I. The welding lip 26*b*" enables a welding ledge in the deflector section I for the back vertical extruder brace 29 of the extruder throat section H. Thus, the welding lip 26*b*" of the back extruder plate 26*b* can be welded to the back vertical extruder brace 29 in the deflector section I. The welding lip 26*b*" can 0.25 to 1.0 inches into the deflector section I. Like the back extruder plate 26*b*', the welding lip 26*b*" can be welded between both the top plate 27*a* and the bottom plate 27*b*.

The deflector section I also includes the second portion of the front plate 26*a*, which is the deflector plate 26*a*" having a curved shape. Like the front extruder plate 26*a*', the deflector plate 26*a*" can be welded between both the top plate 27*a* and the bottom plate 27*b*. An offset impact force transfer brace 32 is attached to the front extruder plate 26*a*' and coupled between the impact plate 31 and the front vertical extruder brace 28.

As shown in FIG. 2*a*, a impact plate portion 32' at the end of the offset impact force transfer brace 32 nearest the impact plate head 31 is located along the central longitudinal axis XX-XX' of the feeder chute section G to assist in directing impact energy on the impact plate 31. Thus, the impact plate portion 32' of the offset impact force transfer brace 32 is along the same path XX-XX' as guardrail feeding into the extruder section H from the feed chute section G during an impact. Further, the impact plate portion 32' of the offset impact force transfer brace 32 is closer to the center Z-Z' of the impact plate 31 so as to increase the rigidity of the central portion of the impact plate 31.

As also shown in FIG. 2*a*, a middle portion 32" of the offset impact force transfer brace 32 can provide added support to the deflector plate 26*a*". The middle portion 32" of the offset impact force transfer brace 32 can be slightly spaced apart from or abutting the deflector plate 26*a*". In another alternative, the middle portion 32" of the offset impact force transfer brace 32 can be welded to the deflector plate 26*a*". Unlike the impact force transfer brace 12 of the prior art guardrail extruder head 1 having 0.25 inch thick steel plate, the offset impact force transfer brace 32 will have a plate thickness of 0.375 to 0.5 inch.

The impact head section D, as shown in FIGS. 2*a*, 2*b* and 2*c*, includes an impact plate 31 with two outwardly projecting sides. In the alternative, the impact plate 31 can have all four sides outwardly projecting. The impact plate 31 is welded to the top plate 27*a*, the bottom plate 27*b* and the impact plate portion 32' at the end of the offset impact force transfer brace 32.

Figure 3:
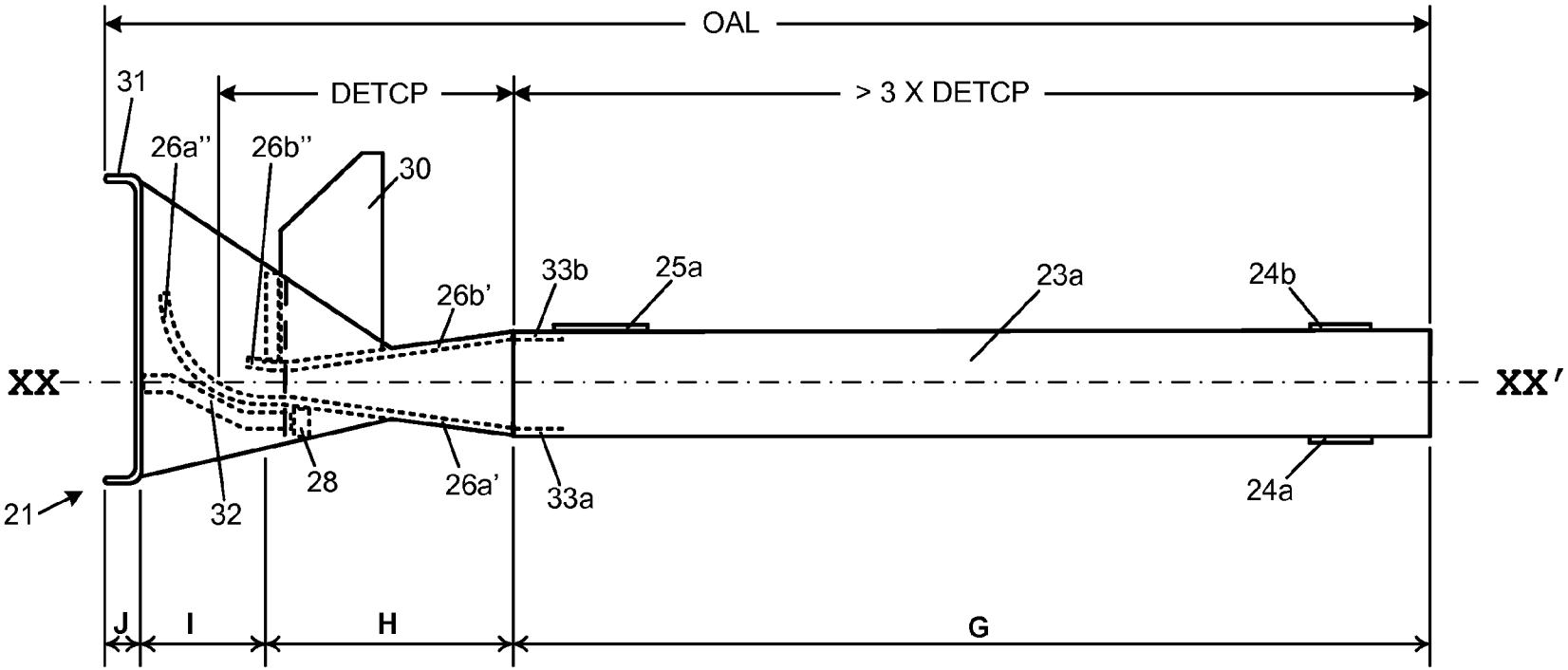
FIG. 3 shows a top view of a guardrail extruder head illustrating the length of the feed chute with respect to the distance through the extruder throat to the curvature of the deflector plate along the centerline of the feed chute.

FIG. 3 shows a top view of a guardrail extruder head illustrating the length of the feed chute with respect to the distance through the extruder throat to the curvature of the deflector plate along the centerline of the feed chute. As shown in FIG. 3, a distance DETCP of the guardrail extruder head 21 is measured along the center line XX-XX' starting at the opening of the extruder throat section H adjacent to the feeder chute section G and ending where the center line XX-XX' crosses the deflector plate 26*a*". Thus, the distance DETCP is the distance through the extruder throat section G to the curvature of the deflector plate 26*a*". The offset impact force transfer brace 32 is shown in FIG. 3 on the other side of the point of the curvature of the deflector plate 26*a*" at which the center line XX-XX' crosses.

As also shown in FIG. 3, the feeder chute section G can have an overall length>3×DETCP measured along the center line that is at least three times greater than the distance DETCP through the extruder throat section H to the deflector plate 26*a*". For example, distances through the extruder throat section H to the curvature plate can be 12.5-14.5 inches. Thus, the length of the feeder chute section G would have to be at least 36.5 inches for a distance of 12.5 inches through the extruder throat section H to the curvature plate or the length of the feeder chute section G would have to be at least 43.5 inches for a distance of 14.5 inches through the extruder throat section H to the curvature plate. The overall length OAL of the guardrail extruder head 21 is the summed lengths of the feeder chute section G, the extruder throat section H, the deflector section I and the impact head section J. A feeder chute section G having a length greater than at least three times greater than the distance DETCP through the extruder throat section H to the deflector plate 26*a*" will reliably guide the W-beam guardrail into the extruder throat section and make the overall length OAL of the guardrail extruder head 21 sufficiently long, such as 63 inches, to fold away the guardrail from the vehicle during a high angle impact.

Figure 4A:
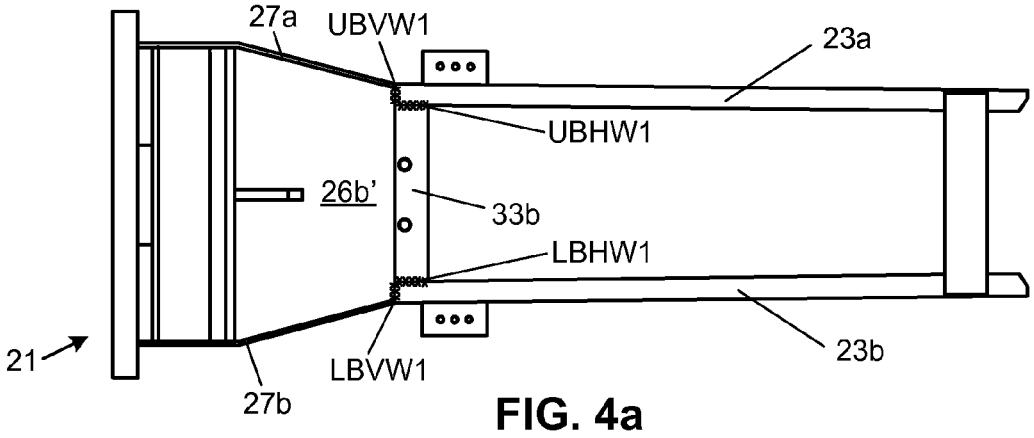
FIG. 4*a* shows a back side view of feeder channel welds of a guardrail extruder head according to the first embodiment of the invention.
Figure 4B:
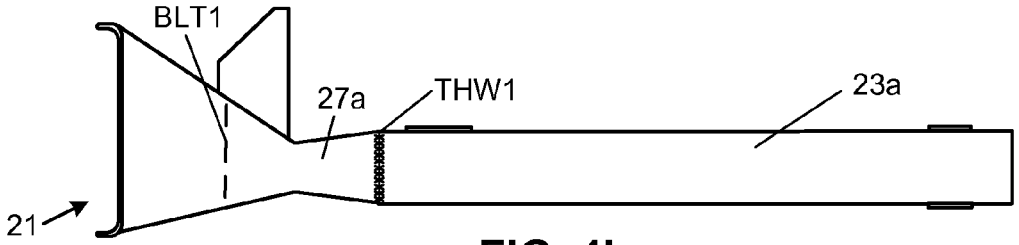
FIG. 4*b* shows a top view of feeder channel welds of a guardrail extruder head according to the first embodiment of the invention.
Figure 4C:
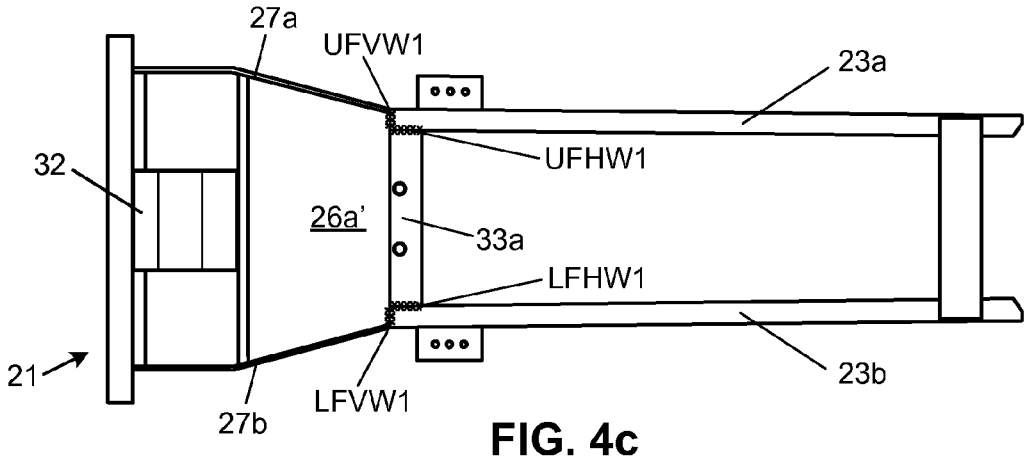
FIG. 4*c* shows a front side view of feeder channel welds of a guardrail extruder head according to the first embodiment of the invention.
Figure 4D:
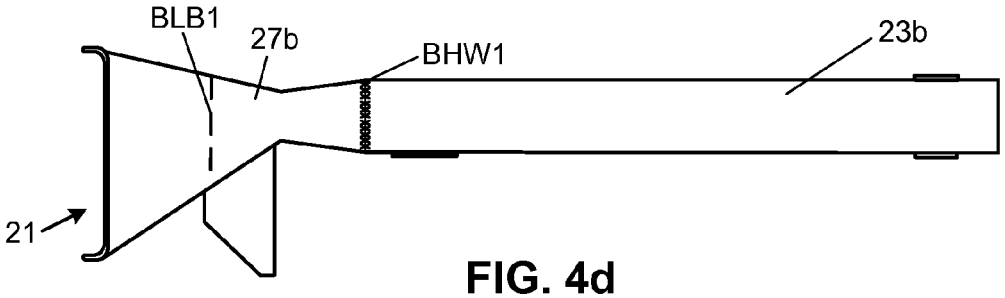
FIG. 4*d* shows a bottom view of feeder channel welds of a guardrail extruder head according to the first embodiment of the invention.

FIG. 4*a* shows a back side view of feeder channel welds of a guardrail extruder head according to the first embodiment of the invention. FIG. 4*b* shows a top view of feeder channel welds of a guardrail extruder head according to the first embodiment of the invention. FIG. 4*c* shows a front side view of feeder channel welds of a guardrail extruder head according to the first embodiment of the invention. FIG. 4*d* shows a bottom view of feeder channel welds of a guardrail extruder head according to the first embodiment of the invention.

As shown in FIGS. 4*a*-4*d*, the top feeder channel 23*a* is connected to the top plate 27*a*, the front extruder plate 26*a*', the back extruder plate 26*b*' and the side plates 33*a* and 33*b* with two horizontal welds UBHW1 and UFHW1, two vertical welds UBVW1 and UFVW1 and another horizontal weld THW1 between the two vertical welds UBVW1 and UFVW1. As also shown in FIGS. 4*a*-4*d*, the bottom feeder channel 23*b* is connected to the bottom plate 27*b*, the front extruder plate 26*a*', the back extruder plate 26*b*' and the side plates 33*a* and 33*b* with two horizontal welds LHW1 and LFHW1, two vertical welds LBVW1 and LFVW1 and another horizontal weld BHW1 between the two vertical welds LBVW1 and LFVW1. FIG. 4*b* shows the bend line BLT1 in the top plate 27*a*. FIG. 4*d* shows the bend line BLB1 in the bottom plate 27*b*. The two horizontal welds UBHW1 and UFHW1 between the side plates 33*a* and 33*b* and the top feeder channel 23*a* enhance the attachment of the top feeder channel 23*a* to the top plate 27*a*, the front extruder plate 26*a*', and the back extruder plate 26*b*' by adding horizontal welds in a different plane and direction than the top horizontal weld THW1. The two horizontal welds LHW1 and LFHW1 between the side plates 33*a* and 33*b* and the bottom feeder channel 23*b* enhance the attachment of the bottom feeder channel 23*b* to the bottom plate 27*b*, the front extruder 26*a*' plate and the back extruder plate 26*b*' by adding horizontal welds in a different plane and direction than the top horizontal weld TBW1.

Figure 5A:
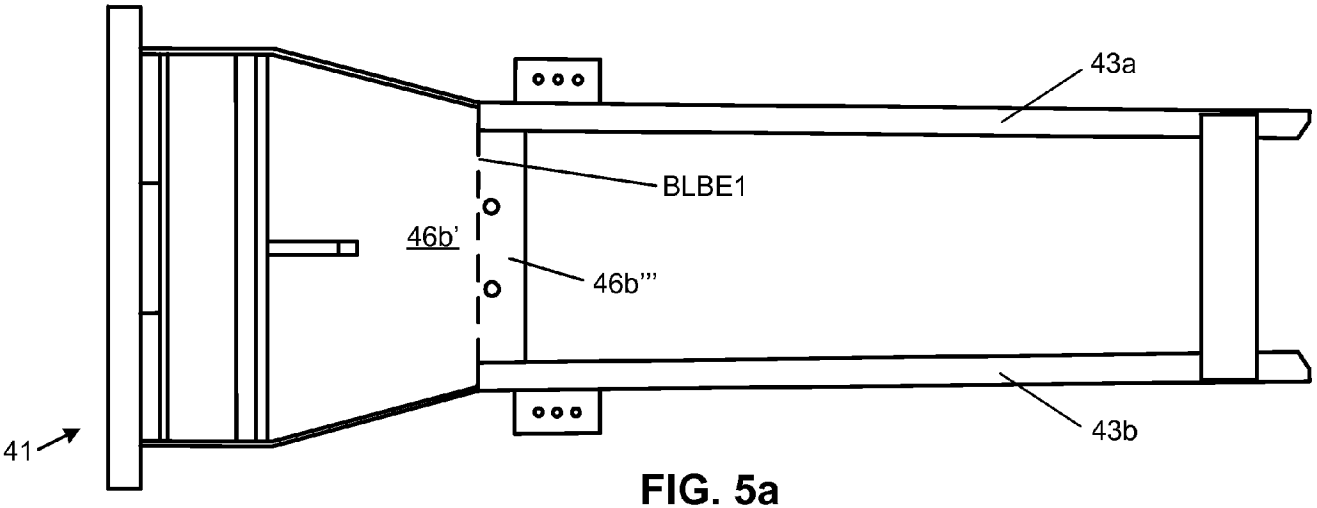
FIG. 5*a* shows a back side view of a guardrail extruder head according to a second embodiment of the invention.

FIG. 5*a* shows a back side view of a guardrail extruder head according to a second embodiment of the invention. As shown in FIG. 5*a*, the back side plate 46*b*'" is an integral part of the back extruder plate 46*b*' in the guardrail extruder head 41 of the second embodiment. The integral back side plate 46*b*'" is made by an extension of the back extruder plate 46*b*' that is notched for the upper and lower feed channels 43*a* and 43*b*. Further, that extension of the back extruder plate 46*b*' is bent BLBE1 to be aligned with and between the upper and lower feed channels 43*a* and 43*b* to make the integral back side plate 46*b*'".

Figure 5B:
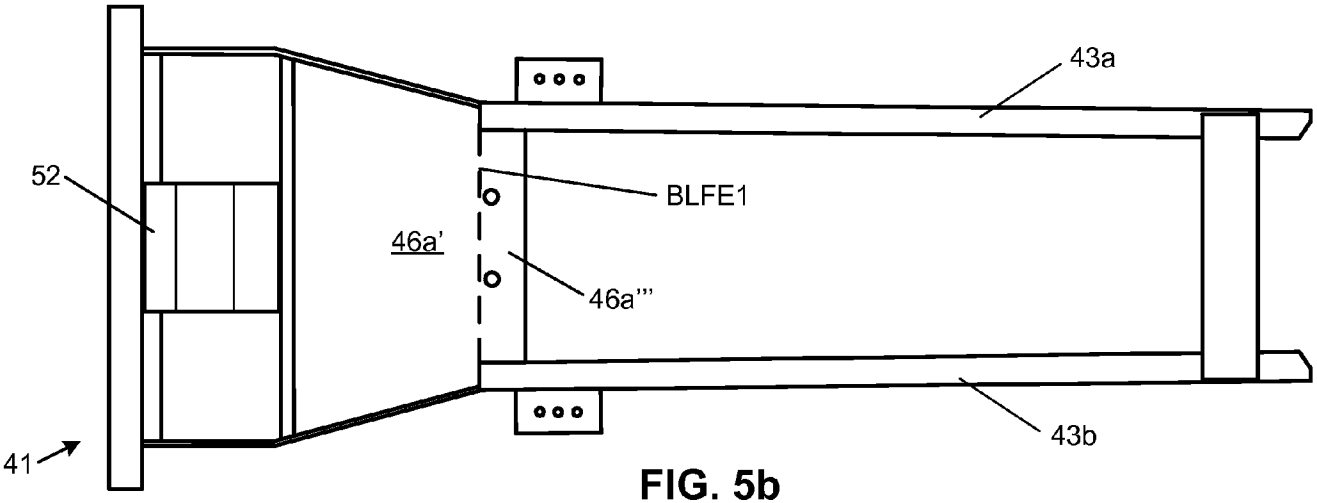
FIG. 5*b* shows a front side view of a guardrail extruder head according to the second embodiment of the invention.

FIG. 5*b* shows a front side view of a guardrail extruder head according to the second embodiment of the invention. As shown in FIG. 5*b*, the front side plate 46*a*'" is an integral part of the front extruder plate 46*a*' in the guardrail extruder head 41 of the second embodiment. The integral front side plate 46*a*'" is made by an extension of the front extruder plate 46A' that is notched for the upper and lower feed channels 43*a* and 43*b*. Further, that extension of the front extruder plate 46*a*' is bent BLFE1 to be aligned with and between the upper and lower feed channels 43*a* and 43*b* to make the integral front side plate 46*a*'".

Figure 6A:
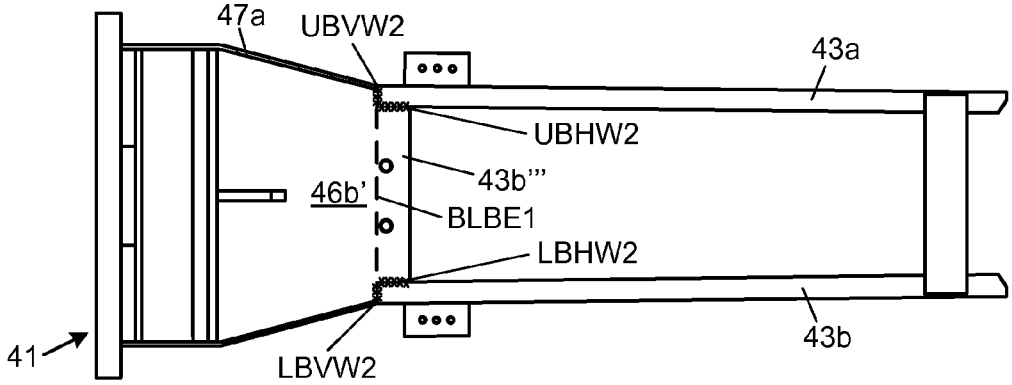
FIG. 6*a* shows a back side view of feeder channel welds of a guardrail extruder head according to the second embodiment of the invention.
Figure 6B:
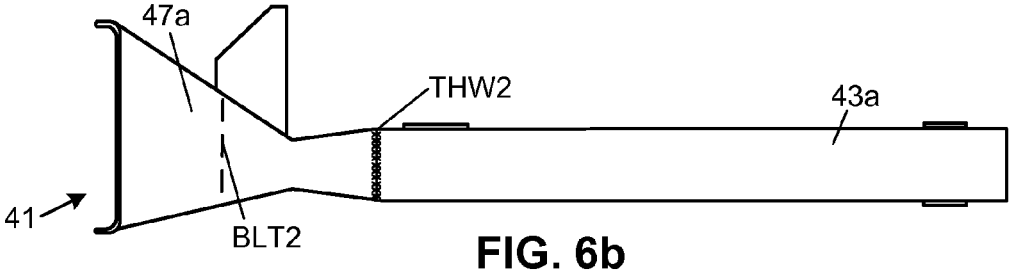
FIG. 6*b* shows a top view of feeder channel welds of a guardrail extruder head according to the second embodiment of the invention.
Figure 6C:
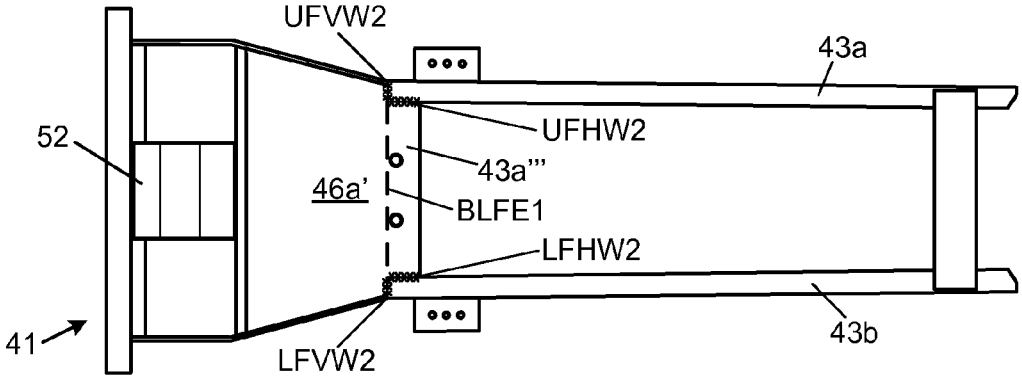
FIG. 6*c* shows a front side view of feeder channel welds of a guardrail extruder head according to the second embodiment of the invention.
Figure 6D:
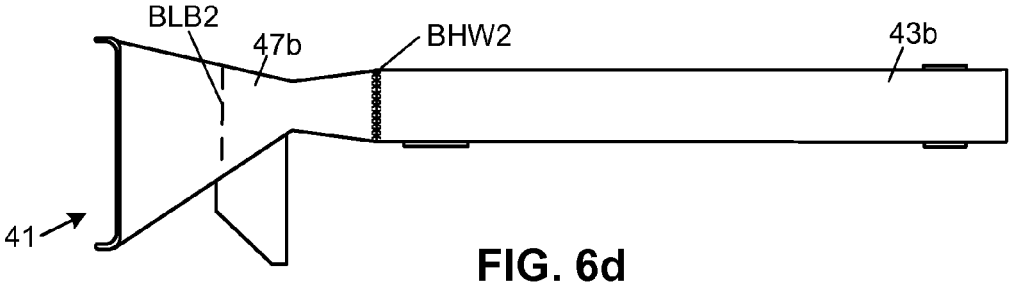
FIG. 6*d* shows a bottom view of feeder channel welds of a guardrail extruder head according to the second embodiment of the invention.

FIG. 6*a* shows a back side view of feeder channel welds of a guardrail extruder head according to the second embodiment of the invention. FIG. 6*b* shows a top view of feeder channel welds of a guardrail extruder head according to the second embodiment of the invention. FIG. 6*c* shows a front side view of feeder channel welds of a guardrail extruder head according to the second embodiment of the invention. FIG. 6*d* shows a bottom view of feeder channel welds of a guardrail extruder head according to the second embodiment of the invention. As shown in FIGS. 6*a*-6*d*, the top feeder channel 43*a* is connected to the top plate 47*a*, the front extruder plate 46*a*', the back extruder plate 46*b*' and the side plates 46*a*'" and 46*b*'" with two horizontal welds UBHW2 and UFHW2, two vertical welds UBVW2 and UFVW2 and another horizontal weld THW2 between the two vertical welds UBVW2 and UFVW2. As also shown in FIGS. 6*a*-6*d*, the bottom feeder channel 43*b* is connected to the bottom plate 47*b*, the front extruder plate 46*a*', the back extruder plate 46*b*' and the side plates 43*a*'" and 43*b*'" with two horizontal welds LHW2 and LFHW2, two vertical welds LBVW2 and LFVW2 and another horizontal weld BHW2 between the two vertical welds LBVW2 and LFVW2. FIG. 6*b* shows the bend line BLT2 in the top plate 47*a*. FIG. 6*d* shows the bend line BLB2 in the bottom plate 47*b*. The two horizontal welds UBHW2 and UFHW2 between the side plates 43*a*'" and 43*b*'" and the top feeder channel 43*a* enhance the attachment of the top feeder channel 43*a* to the top plate 47*a*, the front extruder plate 46*a*', and the back extruder plate 46*b*' by adding horizontal welds in a different plane and direction than the top horizontal weld THW2. The two horizontal welds LHW2 and LFHW2 between the side plates 43*a*'" and 43*b*'" and the bottom feeder channel 43*b* enhance the attachment of the bottom feeder channel 43*b* to the bottom plate 47*b*, the front extruder 46*a*' plate and the back extruder plate 46*b*' by adding horizontal welds in a different plane and direction than the top horizontal weld TBW2.

Figure 7A:
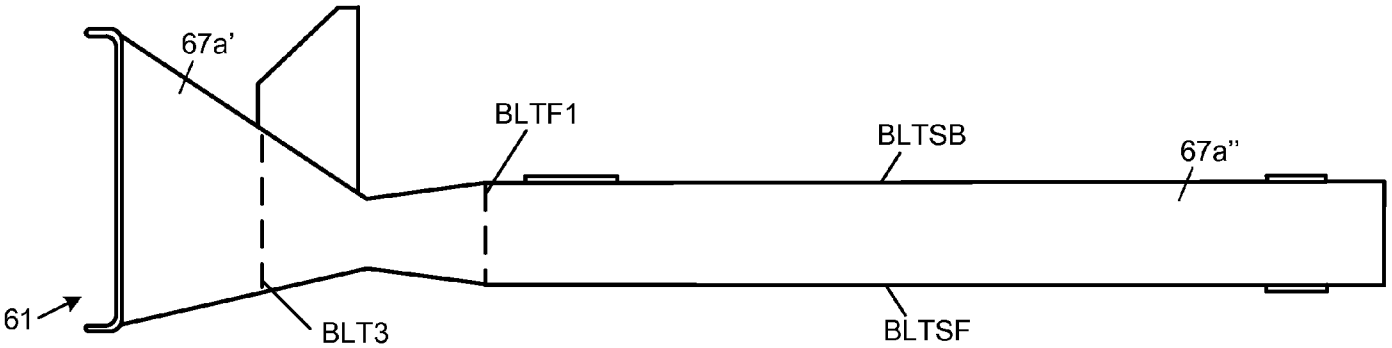
FIG. 7*a* shows a top view of a guardrail extruder head according to a third embodiment of the invention.

FIG. 7*a* shows a top view of a guardrail extruder head according to a third embodiment of the invention. As shown in FIG. 7*a*, the top plate 67*a*' is integral with the top feeder channel 67*a*" in the guardrail extruder head 61 of the third embodiment. A single sheet of material is cut and then bent at least four times to form the top plate 67*a*' integral with the top feeder channel 67*a*". There is a bend BLT3 in a central area of the top plate 67*a*' section, a bend BLTF1 between the top plate 67*a*' section and the top feeder channel 67*a*" section, and bends BLTSB and BLTSF along the length of the top feeder channel 67*a*" section to form sides of the top feeder channel 67*a*" section.

Figure 7B:
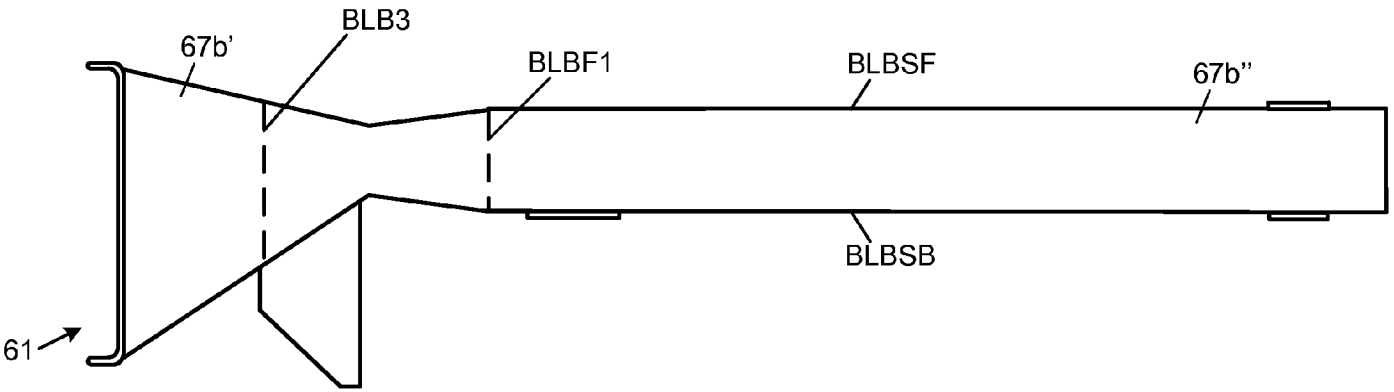
FIG. 7*b* shows a bottom view of a guardrail extruder head according to the third embodiment of the invention.

FIG. 7*b* shows a bottom view of a guardrail extruder head according to the third embodiment of the invention. As shown in FIG. 7*b*, the bottom plate 67*b*' is integral with the bottom feeder channel 67*b*" in the guardrail extruder head 61 of the third embodiment. A single sheet of material is cut and then bent at least four times to form the bottom plate 67*b*' integral with the bottom feeder channel 67*b*". There is a bend BLB3 in a central area of the bottom plate 67*b*' section, a bend BLBF1 between the bottom plate 67*b*' section and the bottom feeder channel 67*b*" section, and bends BLBSB and BLBSF along the length of the bottom feeder channel 67*b*" section to form sides of the bottom feeder channel 67*b*" section. Integrating the feed channels into the top and bottom plates eliminates the cost of welding the feed channels to the top and bottom plates.

Figure 8A:
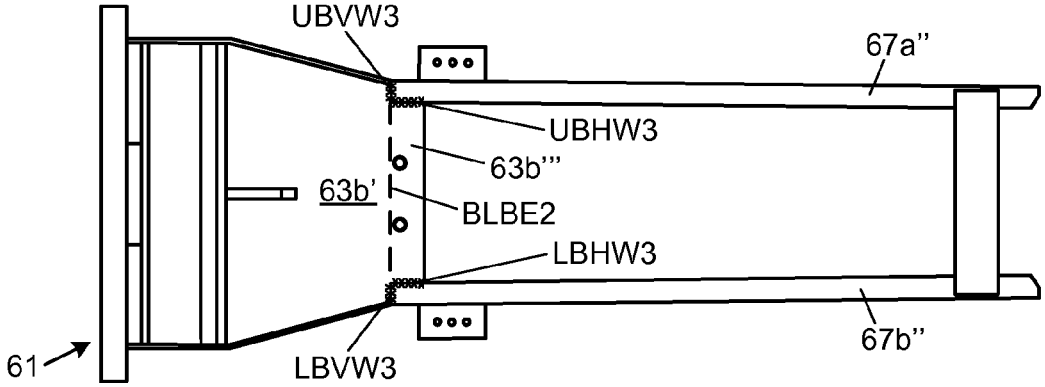
FIG. 8*a* shows a back side view of feeder channel welds of a guardrail extruder head according to the third embodiment of the invention.
Figure 8B:
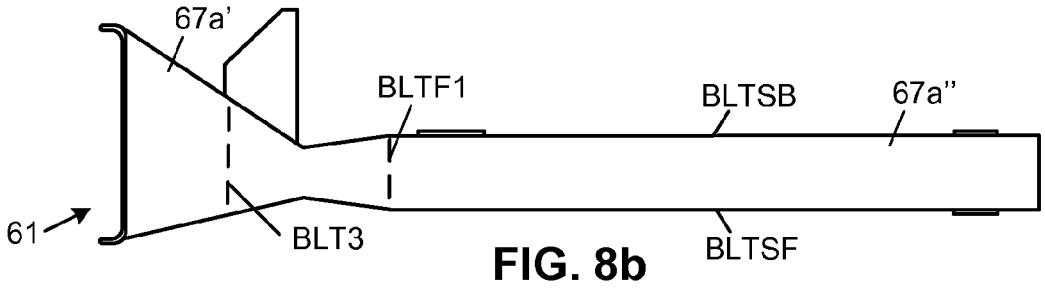
FIG. 8*b* shows a top view of feeder channel welds of a guardrail extruder head according to the third embodiment of the invention.
Figure 8C:
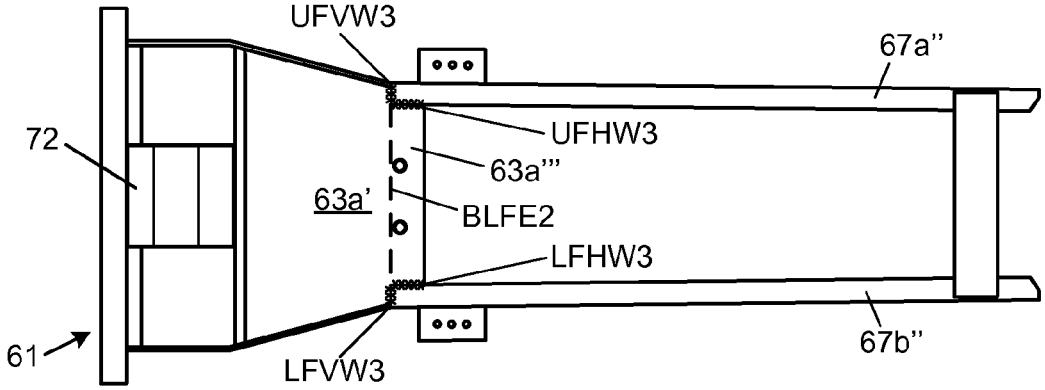
FIG. 8*c* shows a front side view of feeder channel welds of a guardrail extruder head according to the third embodiment of the invention.
Figure 8D:
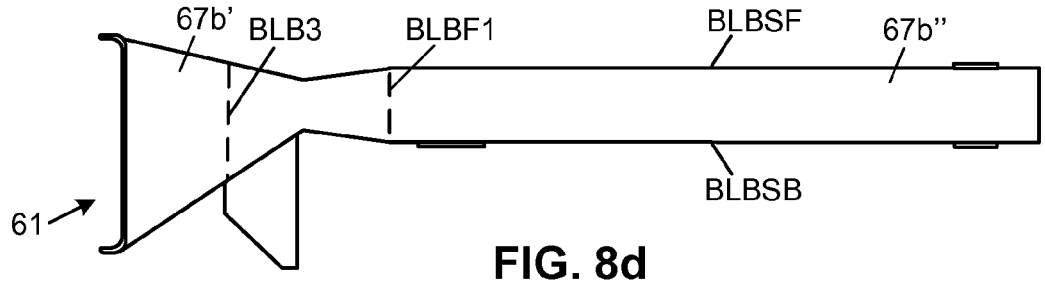
FIG. 8*d* shows a bottom view of feeder channel welds of a guardrail extruder head according to the third embodiment of the invention.

FIG. 8*a* shows a back side view of feeder channel welds of a guardrail extruder head according to the third embodiment of the invention. FIG. 8*b* shows a top view of feeder channel welds of a guardrail extruder head according to the third embodiment of the invention. FIG. 8*c* shows a front side view of feeder channel welds of a guardrail extruder head according to the third embodiment of the invention. FIG. 8*d* shows a bottom view of feeder channel welds of a guardrail extruder head according to the third embodiment of the invention. As shown in FIGS. 8*a*-8*d*, the top feeder channel 67*a*" is integral with the top plate 67*a*' and connected to the front extruder plate 63*a*', the back extruder plate 63*b*', the side plate 63*a*'" integral with the front extruder plate 63*a*' and the side plate 63*b*''' integral with the back extruder plate 63*b*' by two horizontal welds UBHW3 and UFHW3 along with two vertical welds UBVW3 and UFVW3. As also shown in FIGS. 8*a*-8*d*, the bottom feeder channel 67*b*'' is integral with the bottom plate 67*b*' and connected to the front extruder plate 63*a*', the back extruder plate 63*b*', the side plate 63*a*''' integral with the front extruder plate 63*a*' and the side plate 63*b*''' integral with the back extruder plate 63*b*' by two horizontal welds LBHW3 and LFHW3 along with two vertical welds LBVW3 and LFVW3. The two horizontal welds UBHW3 and UFHW3 between the side plates 63*a*''' and 63*b*''' and the top feeder channel 67*a*'' enhance the stability of the top feeder channel 67*a*'' with respect to the top plate 67*a*', the front extruder plate 63*a*', and the back extruder plate 63*b*' by adding horizontal welds in a different plane and direction than the bend BLTF1 between the top plate 67*a*' section and the top feeder channel 67*a*'' section. The two horizontal welds LHW3 and LFHW3 between the side plates 63*a*''' and 63*b*''' and the bottom feeder channel 67*b*'' enhance the stability of the bottom feeder channel 67*b*'' with respect to the bottom plate 67*b*', the front extruder 63*a*' plate and the back extruder plate 63*b*' by adding horizontal welds in a different plane and direction than the bend BLBF1 between the top plate 67*a*' section and the top feeder channel 67*a*'' section.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A guardrail extruder head comprising:

a feeder chute having a top feeder channel and a bottom feeder channel with a central longitudinal axis;

an impact plate for facing oncoming traffic;

a top plate connecting the impact plate and the top feeder channel;

a bottom plate connecting the impact plate and the bottom feeder channel;

a front extruder plate extending from the feeder chute and coupled between the top plate and the bottom plate;

a curved deflector plate attached to the front extruder plate and coupled between the top plate and the bottom plate;

a front brace on the front extruder plate near the curved deflector plate and coupled between the top plate and the bottom plate;

a back extruder plate opposite to the front extruder plate and coupled between the top plate and the bottom plate, the back extruder plate having a first end adjacent to the feeder chute and a second end opposite to the first end;

a front side plate extending from the front extruder plate positioned between the top feeder channel and the bottom feeder channel, wherein the front side plate has a witness hole;

a back side plate extending from the back extruder plate positioned between the top feeder channel and the bottom feeder channel, wherein the back side plate has a witness hole;

a back brace on the back extruder plate near the second end and coupled between the top plate and the bottom plate; and an impact force transfer brace coupled to the front brace and the impact plate.

2. The guardrail extruder head according to claim 1, wherein a portion of the impact force transfer brace is aligned with the central longitudinal axis of the feeder chute.

3. The guardrail extruder head according to claim 1, wherein the front side plate is integral with the front extruder plate and the back side plate is integral with the back extruder plate.

4. The guardrail extruder head according to claim 1, wherein the top feeder channel and the bottom feeder channel each have a length within a range of 37 to 50 inches.

5. A guardrail extruder head comprising:

a feeder chute having a top feeder channel and a bottom feeder channel with a central longitudinal axis;

an impact plate for facing oncoming traffic;

a top plate connecting the impact plate and the top feeder channel;

a bottom plate connecting the impact plate and the bottom feeder channel;

a front extruder plate extending from the feeder chute and coupled between the top plate and the bottom plate;

a curved deflector plate attached to the front extruder plate and coupled between the top plate and the bottom plate;

a front brace on the front extruder plate near the curved deflector plate and coupled between the top plate and the bottom plate;

a back extruder plate opposite to the front extruder plate and coupled between the top plate and the bottom plate, the back extruder plate having a first end adjacent to the feeder chute and a second end opposite to the first end;

a front side plate extending from the front extruder plate and positioned between the top feeder channel and the bottom feeder channel, wherein the front side plate is welded to the top feeder channel and to the bottom feeder channel;

a back side plate extending from the back extruder plate and positioned between the top feeder channel and the bottom feeder channel, wherein the back side plate is welded to the top feeder channel and to the bottom feeder channel;

a back brace on the back extruder plate near the second end and coupled between the top plate and the bottom plate; and an impact force transfer brace coupled to the front brace and the impact plate.

6. The guardrail extruder head according to claim 5, wherein a portion of the impact force transfer brace is aligned with the central longitudinal axis of the feeder chute.

7. The guardrail extruder head according to claim 5, wherein the front and back side plates each have a witness hole.

8. The guardrail extruder head according to claim 5, wherein the front side plate is integral with the front extruder plate and the back side plate is integral with the back extruder plate.

9. The guardrail extruder head according to claim 5, wherein the top feeder channel and the bottom feeder channel each have a length within a range of 37 to 50 inches.

10. A guardrail extruder head comprising:

a feeder chute having a top feeder channel and a bottom feeder channel with a central longitudinal axis;

an impact plate for facing oncoming traffic;

a top plate extending to the impact plate from the top feeder channel, wherein the top plate is welded to the top feeder channel;

a bottom plate extending to the impact plate from the bottom feeder channel, wherein the bottom plate is welded to the bottom feeder channel;

a front extruder plate extending from the feeder chute and coupled between the top plate and the bottom plate, wherein the front extruder plate is welded to the feeder channels;

a curved deflector plate attached to the front extruder plate and coupled between the top plate and the bottom plate;

a front brace on the front extruder plate near the curved deflector plate and coupled between the top plate and the bottom plate;

a back extruder plate opposite to the front extruder plate and coupled between the top plate and the bottom plate, the back extruder plate having a first end adjacent to the feeder chute and a second end opposite to the first end, wherein the first end of the back extruder plate is welded to the feeder channels;

a back side plate extending from the back extruder plate positioned between the top feeder channel and the bottom feeder channel adjacent to the first end, wherein the back side plate is welded to the top feeder channel and to the bottom feeder channel;

a front side plate extending from the front extruder plate positioned between the top feeder channel and the bottom feeder channel opposite the back side plate, wherein the front side plate is welded to the top feeder channel and to the bottom feeder channel;

a back brace on the back extruder plate near the second end and coupled between the top plate and the bottom plate; and an impact force transfer brace coupled between the front brace and the impact plate.

11. The guardrail extruder head according to claim 10, wherein a portion of the impact force transfer brace is aligned with the central longitudinal axis of the feeder chute.

12. The guardrail extruder head according to claim 10, wherein the front and back side plates each have a witness hole.

13. The guardrail extruder head according to claim 10, wherein the top feeder channel and the bottom feeder channel each have a length within a range of 37 to 50 inches.

* * * * *